United States Patent [19]

Martinez

[11] Patent Number: 5,074,689

[45] Date of Patent: Dec. 24, 1991

[54] RIBBON CASSETTE WITH INTEGRAL PAPER GUIDE

[75] Inventor: Phillip M. Martinez, Dryden, N.Y.

[73] Assignee: Smith Corona Corporation, Cortland, N.Y.

[21] Appl. No.: 597,123

[22] Filed: Oct. 15, 1990

Related U.S. Application Data

[63] Continuation-in-part of Ser. No. 464,509, Jan. 12, 1990, abandoned.

[51] Int. Cl.[5] ..... B41J 35/28

[52] U.S. Cl. ..... 400/208; 400/247

[58] Field of Search ..... 400/194-196.1, 400/207, 208, 208.1, 247, 248, 248.1, 248.3

[56] References Cited

U.S. PATENT DOCUMENTS

| | | | |
|---|---|---|---|
| 1,758,109 | 5/1930 | Going | 400/638 |
| 2,152,858 | 4/1939 | Becker | 400/638 |
| 3,977,511 | 8/1976 | Hengelhaupt | 400/248 |
| 4,212,552 | 7/1980 | Bemis et al. | 400/249 |
| 4,245,916 | 1/1981 | Habich et al. | 400/144.2 |
| 4,264,221 | 4/1981 | Habich et al. | 400/144.2 |
| 4,291,993 | 9/1981 | Gagnebin | 400/144.2 |
| 4,310,255 | 1/1982 | Asano et al. | 400/171 |
| 4,315,694 | 2/1982 | Habich et al. | 400/144.2 |
| 4,330,218 | 5/1982 | Habich et al. | 400/144.2 |
| 4,370,071 | 1/1983 | Habich et al. | 400/144.2 |
| 4,383,775 | 5/1983 | Trammell et al. | 400/248 |
| 4,408,909 | 10/1983 | Asano et al. | 400/144.2 |
| 4,408,912 | 10/1983 | Yonkers | 400/208 |
| 4,408,914 | 10/1983 | Ciesiel et al. | 400/208 |
| 4,616,945 | 10/1986 | Komplin | 400/697.1 |
| 4,629,345 | 12/1986 | Suzaki et al. | 400/208 |
| 4,652,154 | 3/1987 | Horiya et al. | 400/208 |
| 4,793,723 | 12/1988 | Furhata | 400/208 |
| 4,867,586 | 9/1989 | Shimoyama | 400/208 |
| 4,900,170 | 2/1990 | Beck et al. | 400/208 |
| 4,917,515 | 4/1990 | Piller et al. | 400/208 |
| 4,921,363 | 5/1990 | Nishihara et al. | 400/208 |
| 4,971,463 | 11/1990 | Daley et al. | 400/208 |

FOREIGN PATENT DOCUMENTS

| | | | |
|---|---|---|---|
| 3502470 | 7/1986 | Fed. Rep. of Germany | 400/248 |
| 0154878 | 7/1986 | Japan | 400/248 |

OTHER PUBLICATIONS

"Cardholder-Ribbon Guide Combination for Printers", IBM Tech. Discl. Bulletin, vol. 21, No. 12, 5/79, pp. 4744-4746.

"Ribbon Shield with Integral Aligner and Turning Stanchions", IBM Tech. Discl. Bulletin, vol. 22, No. 8A, 1/80 pp. 3071-3072.

*Primary Examiner*—Eugene H. Eickholt

[57] ABSTRACT

An improved dual purpose print ribbon cartridge for use with a typewriter or printer having upper and lower walls joined by side walls one of which is a front sidewall. The cartridge being provided with ribbon exit and entrance ports at opposite ends of one of the front sidewalls for movement of said ribbon along and spaced from said front sidewall. Said front sidewall being formed with an upwardly directed extension for guiding the paper, after printing, in an upwardly direction.

30 Claims, 2 Drawing Sheets

FIG. 3
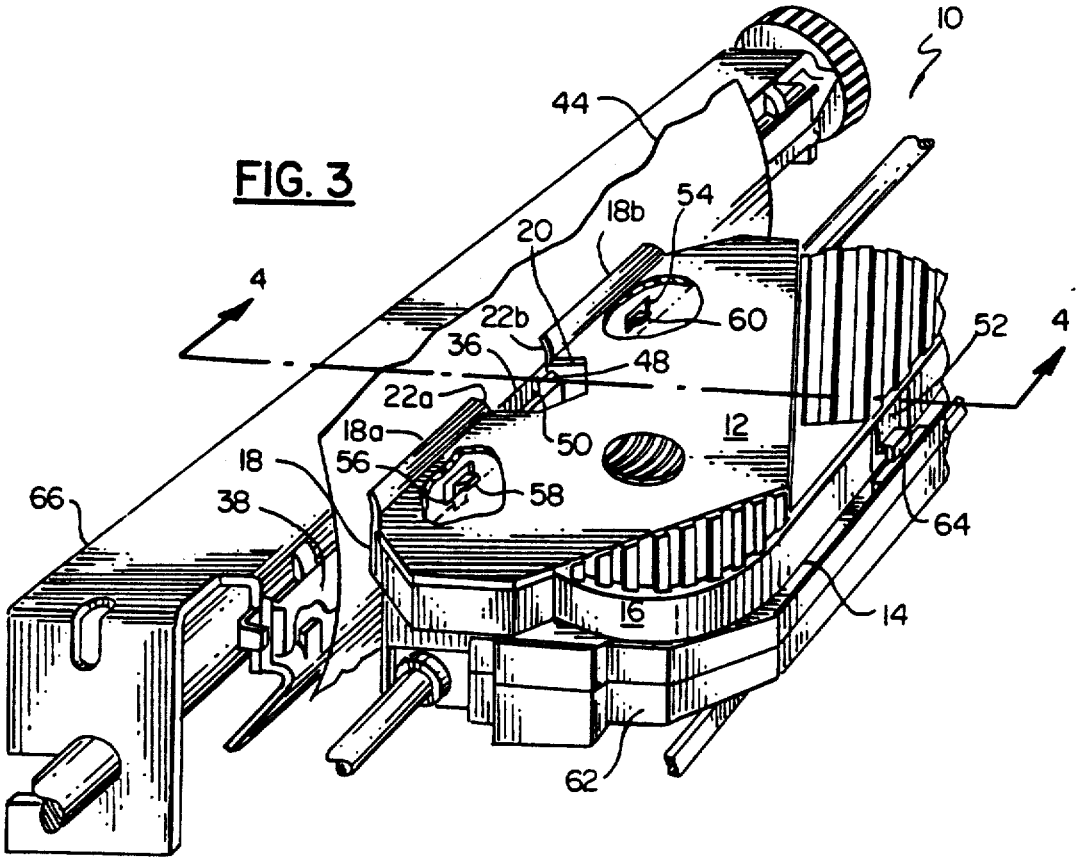
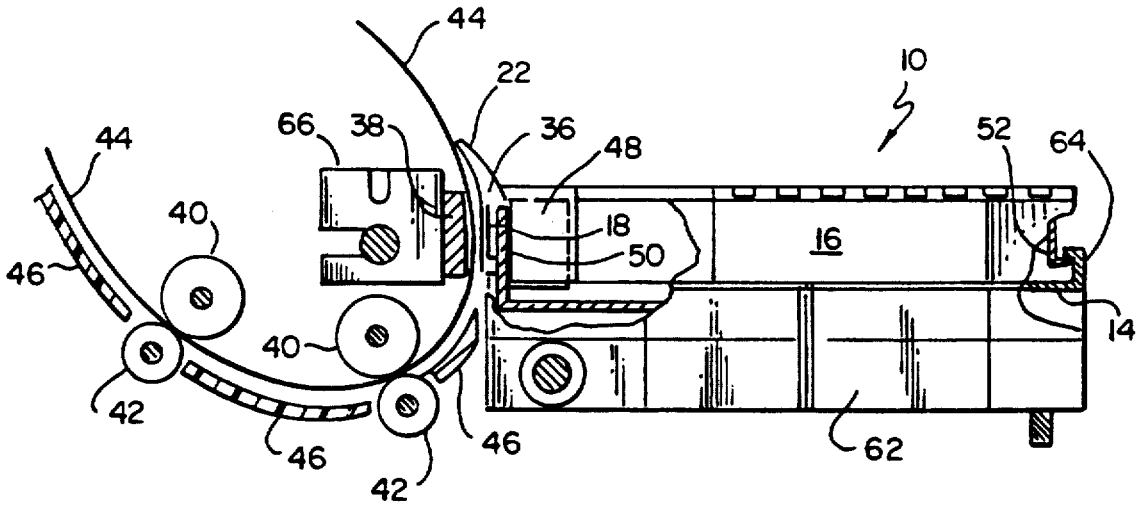
FIG. 4

RIBBON CASSETTE WITH INTEGRAL PAPER GUIDE

CROSS-REFERENCE TO RELATED APPLICATIONS

This application is a continuation-in-part of now abandoned U.S. patent application Ser. No. 07/464,509 filed Jan. 12, 1990 and entitled "Ribbon Cassette with Integral Paper Guide".

STATEMENT AS TO RIGHTS TO INVENTION MADE UNDER FEDERALLY SPONSORED RESEARCH AND DEVELOPMENT

The invention disclosed and claimed herein was not made under any federally sponsored research and development program.

BACKGROUND OF THE INVENTION (1) Field of the Invention

The present invention relates generally to typewriters and printers and more particularly pertains to a dual purpose print ribbon cassette or cartridge having a paper guide means for use therein.

(2) Description of the Prior Art

It has long been the practice in the typewriter art to provide typewriters with paper guides to direct the paper or medium upon which the printing will take place, to a position substantially proximate the platen. Such guides have included pinch rollers and paper bails. Examples of such paper guides are disclosed in U.S. Pat. Nos. 1,758,109 and 2,152,858.

Recently, what are referred to as card holders or card presses have been incorporated as elements of printwheel cartridges. Such structures are disclosed, for example, in U.S. Pat. Nos. 4,212,552, 4,245,916, 4,264,221, 4,310,255, 4,315,694, 4,330,218, 4,370,071, and 4,408,909. These patents disclose vertically oriented printwheel cartridges for use in impacting printing devices such as printers and typewriters. Such printwheel cartridges include upwardly extending arcuately shaped extensions which match the curvature of the platen. The cartridges are supported and carried by the carriage which reciprocates or moves laterally between the ends of the platen. Another version of the card press not integral with typewriter is disclosed in U.S. Pat. No. 4,291,993 wherein a card press is supported independently on a moving carrier and which is not formed with or as part of a cartridge.

The related application referenced above includes a paper guide which extends from and is integral with the upper wall of the ribbon cartridge, as distinguished from the present case, wherein the paper guide extends from and is integral with the sidewall of the ribbon cartridge. In the paper guide disclosed in the related application, it was found that the paper exhibited could engage or catch the junction formed by the cartridge sidewall edge and the upper wall (from which the paper guide extended) and thereby impeded the movement of the paper.

The present invention discloses a dual purpose print ribbon cartridge which is shown as horizontally supported on a carrier for lateral movement along, but spaced apart from, the platen of the printing device. A front side wall of the cartridge is opposite the platen and is provided with both an exit and an entrance aperture for travel of the print ribbon confined within the cartridge. The front side wall is formed with an integral upwardly extending arcuate portion that rises beyond the cartridge upper wall to provide a relatively narrow passageway to guide the paper. In this manner, the junction formed by the cartridge sidewall edge and the upper wall is eliminated, and with it, any tendency of the paper to engage the aforementioned junction. The cartridge is further formed with a vertical opening therethrough to accommodate a moving printhead. There is thus provided a dual purpose print cartridge or cassette.

SUMMARY OF THE INVENTION

The purpose of the present invention is to provide a dual purpose print ribbon cartridge for a typewriter or printer that has all the advantages of similarly employed prior art cartridges and provides the additional paper guide function. The present invention comprises a print ribbon cartridge having a front side wall formed with an upwardly extending portion that guides the paper medium between the cartridge and the platen.

The provision of the paper guide which is formed as an integral part of the cartridge eliminates the necessity of incorporating a paper guide as an independent element in the typewriter or printer and thereby reduces the cost of fabrication and assembly of the typewriter. The additional cost of fabricating the dual purpose cartridge of this invention is relatively insignificant as compared with the cost of manufacturing a separate paper guide element for incorporation into the typewriter. In addition, should the prior art paper guide attached to the typewriter break, the entire typewriter would likely have to be transported to a service establishment for repair. In contrast, any defect in the paper guide of the present invention merely requires replacement of the cartridge with a new cartridge.

Accordingly, it is an object of this invention to provide a low cost, reliable, readily serviceable paper guide which is integral with the print ribbon cartridge for use in a typewriter or printer.

Other objects and many of the attendant advantages of this invention will be readily appreciated as the same becomes better understood by reference to the following detailed description when considered in connection with the accompanying drawings in which like reference numerals designate like parts throughout the figures thereof.

BRIEF DESCRIPTION OF THE DRAWINGS

FIG. 3 is a perspective side elevation view of the ribbon cartridge when disposed within the typewriter for use therewith; and FIG. 4 is a side sectional elevation taken approximately along line 4—4 of FIG. 3 viewed in the direction of the arrows.

DETAILED DESCRIPTION OF THE PREFERRED EMBODIMENT

Figure 1:
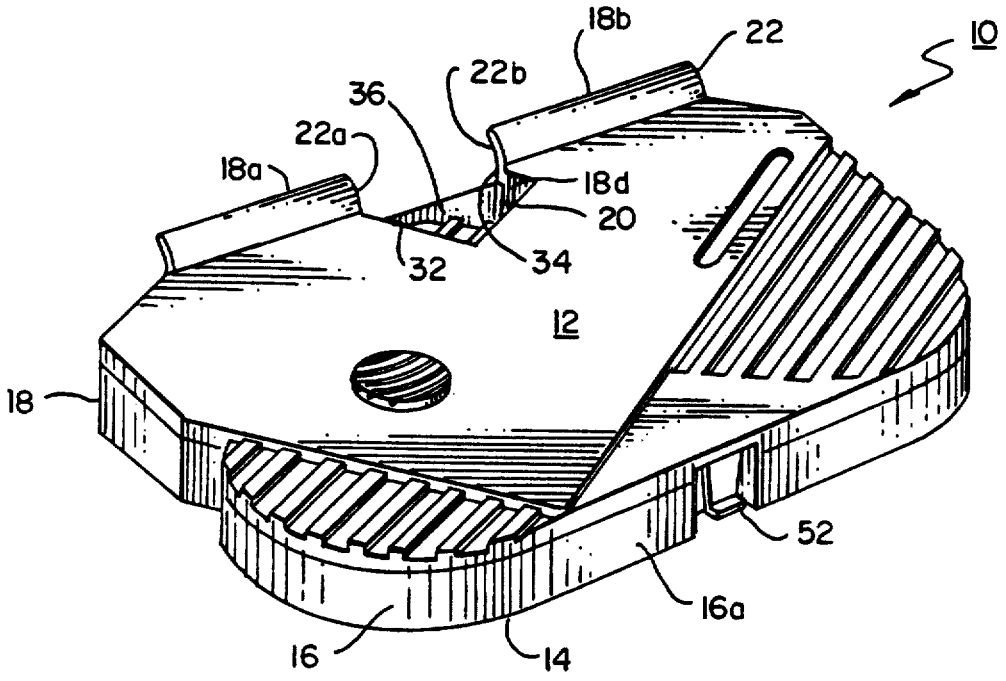
FIG. 1 is a perspective rear elevation view of the dual purpose ribbon cartridge constructed in accordance with the present invention.
Figure 2:
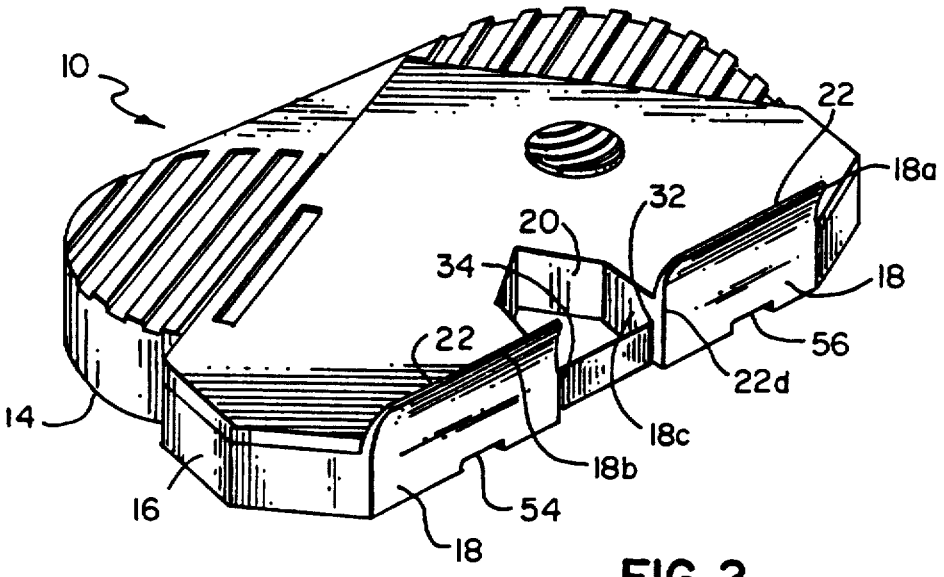
FIG. 2 is a front elevation view of the ribbon cartridge.

In the illustrated embodiment of FIGS. 1 and 2 a dual purpose print ribbon cartridge is generally designated at 10 and includes an upper wall 12 and a lower or base wall 14 spaced therefrom. The cartridge 10 contains a print ribbon 36 which may be a thermal or other type ribbon. Upper and lower walls 12, 14 are joined together along their respective edges by sidewall 16 to thereby form a housing for confining the print ribbon 36. Side wall 16 includes a front sidewall 18. The cartridge 10 as is well known, may be made of any suitable material such as polystyrene or ABS. The cartridge 10 is formed with an inwardly directed opening or gap 20 along front side wall 18 within which a typewriter printhead is located.

As is well known in the art, ribbon cartridges provide storage for a quantity of print ribbon 36 as well as means which coact with the typewriter or printer on which the cartridge 10 is mounted, to mechanically move the ribbon 36 in a loop, from an exit to an entrance opening in the cartridge 10. See, for example U.S. Pat. No. 4,616,945. In the present invention the cartridge 10 is formed with an exit port 32 and an entrance port 34 in opposing walls 18*c* and 18*d* defining the opening 20 of the front sidewall 18 across which an exposed portion of print ribbon 36 extends.

The front sidewall 18 is thus divided into two portions 18*a* and 18*b* and is formed with an upwardly extending arcuate portions 22*a* and 22*b* for guiding paper or other medium on which the printing is to occur. These guide portions 22*a* and 22*b* may take a variety of cross-sectional shapes including straight, angular, as well as arcuate or any combination thereof. The particular shape selected will be dependent on such variables as stiffness of the printing media and the spacing between the cartridge 10 and the platen. The rear sidewall 16*a* is formed with a indented spring-like latch member 52.

FIG. 2 illustrates, in addition to the foregoing, a pair of slots 54 and 56 formed in the lower portion of front sidewall 18 for receiving a pair of latch fingers.

Referring now to FIG. 3 wherein the cartridge 10 is shown horizontally supported within a typewriter or printer on a movable carrier 62 for lateral movement along a platen 38. The cartridge 10 is not only supported on the carrier 62 but is releaseably affixed to the carrier in order to maintain a fixed position with respect to the platen 38. For this purpose the carrier 62 is provided with a rear flexible "L" shaped latching element 64 which engages mating cartridge latch member 52 and a pair of front latch fingers 58 and 60 that mate and engage cartridge slots 54 and 56. Since the latching components are relatively flexible, the cartridge can be readily inserted and removed from the carrier when it is to be replaced. Firm latching of the cartridge 10 prevents the paper 44 from lifting the front edge of the cartridge 10 as it might if the paper 44 would catch against the juncture of the side and upper walls where the guide was integral with the upper wall 12 instead of the sidewall 18. Any force exerted by the paper 44 will cause the front edge of the cartridge 10 to lift up and alter the paper exit geometry thereby resulting in paper misfeed.

As shown in FIG. 4 the typewriter includes a series of inner pinch rollers 40 and outer opposed pinch rollers 42 for moving paper 44 along typewriter guide 46 upwardly toward the opening or space between the cartridge ribbon 36 and platen 38, which may be a hard elongated bar supported on a stationary bracket 66. The paper 44 on exiting the area between the platen 38 and the cartridge 10 is directed and guided by the arcuate extension 22 of the cartridge front sidewall 18. The thermal printhead 48 shown diagrammatically is supported on the typewriter carrier 62 with its operating face 50 opposite and adjacent the print ribbon 36. Although the ribbon cartridge 10 has been illustrated and described with respect to thermal printing it may be readily adapted for other forms of printing such as dot matrix or impact daisy wheel.

Obviously many modifications and variations of the present invention are possible in the light of the above teachings. It is therefore to be understood that, within the scope of the appended claims, the invention may be practiced otherwise than specifically described.

Having thus described the invention, what is claimed as novel and desired to secure by Letters Patent is:

1. In an improved print ribbon cartridge for use with a typewriter or printer having a platen, a carrier movable along the platen which supports the cartridge, a printhead supported on the carrier for operating in conjunction with the print ribbon in the cartridge to cause printing of symbols on a paper, the improved cartridge comprising:

upper and lower walls joined at their peripheral edges by sidewalls to define a cartridge housing for confining a length of print ribbon therein;

one of said sidewalls being a front sidewall, said front sidewall having an exit port and an entrance port to permit the ribbon to exit the cartridge and pass along the front sidewall and enter the cartridge; and said front sidewall being spaced from the paper and having an upwardly extending portion for guiding the paper.

2. The improved cartridge according to claim 1 wherein the extending guide portion is formed integral with the front sidewall.

3. The improved cartridge according to claim 1 wherein the cartridge is provided with an opening intermediate the ends of said front sidewall.

4. The improved cartridge according to claim 1 wherein the extending guide portion is arcuate in cross-section.

5. The improved cartridge according to claim 1 further including latching means for releaseably affixing the cartridge to the carrier.

6. The improved cartridge according to claim 5 wherein the latching means include slots in the front sidewall and a flexible finger formed in the sidewall opposite the front sidewall for engaging mating members on the carrier.

7. The improved cartridge according to claim 1 wherein the upwardly extending guide portion is formed integral with said front sidewall.

8. The improved cartridge according to claim 1, wherein the upwardly extending portion of the front sidewall extends above the upper wall of the cartridge.

9. In an improved print ribbon cartridge for use with a typewriter or printer having a platen, a carrier movable along the platen which supports the cartridge, a printhead supported on the carrier for operating in conjunction with the print ribbon carried by the cartridge to cause printing of symbols on a paper, the improved cartridge comprising:

upper and lower walls joined at their peripheral edges by sidewalls to define a cartridge housing for confining a length of print ribbon therein;

a front sidewall being provided intermediate the ends thereof with an opening whose opposite sidewalls include an exit port and an entrance port for the ribbon housed in the cartridge to permit the ribbon to exit the cartridge pass across the opening and enter the cartridge; and, said front sidewall being spaced from the paper and having an upwardly extending portion for guiding the paper.

10. The improved cartridge according to claim 9 wherein the extending guide portion is formed integral with the front sidewall.

11. The improved cartridge according to claim 9 wherein the extending guide portion is arcuate in cross-section.

12. The improved cartridge according to claim 9 further including latching means for releasably affixing the cartridge to the carrier.

13. The improved cartridge according to claim 12 wherein the latching means include slots in the frontwall and a flexible finger formed in the sidewall opposite the frontwall for engaging mating members on the carrier.

14. The improved cartridge according to claim 9 wherein the upwardly extending guide portion is formed integral with said front sidewall.

15. The improved cartridge according to claim 9, wherein the upwardly extending portion of the front sidewall extends above the upper wall of the cartridge.

16. An improved print ribbon cartridge comprising:

upper and lower walls joined at their peripheral edges by sidewalls to define a cartridge housing for confining a length of print ribbon therein;

one of said sidewalls being a front sidewall, said front sidewall having an exit port and an entrance port to permit the ribbon to exit the cartridge and pass along the front sidewall and enter the cartridge; and said front sidewall being spaced from the paper and having an upwardly extending portion for guiding the paper.

17. The improved cartridge according to claim 16 wherein the extending guide portion is formed integral with the cartridge.

18. The improved cartridge according to claim 16 wherein the cartridge is provided with an opening intermediate the ends of said front sidewall.

19. The improved cartridge according to claim 16 wherein the extending guide portion is arcuate in cross-section.

20. The improved cartridge according to claim 16 further including latching means for releaseably affixing the cartridge to the carrier.

21. The improved cartridge according to claim 20 wherein the latching means include slots in the front sidewall and a flexible finger formed in the sidewall opposite the front sidewall for engaging mating members on the carrier.

22. The improved cartridge according to claim 10 wherein the upwardly extending guide portion is formed integral with said front sidewall.

23. The improved cartridge according to claim 16, wherein the upwardly extending portion of the front sidewall extends above the upper wall of the cartridge.

24. an improved print ribbon cartridge comprising:

upper and lower walls joined at their peripheral edges by sidewalls to define a cartridge housing for confining a length of print ribbon therein;

a front sidewall being provided intermediate the ends thereof with an opening whose opposite sidewalls include an exit port and an entrance port for the ribbon housed in the cartridge to permit the ribbon to exit the cartridge pass across the opening and enter the cartridge; and, said front sidewall being spaced from the paper and having an upwardly extending portion for guiding the paper.

25. The improved cartridge according to claim 24 wherein the extending guide portion is formed integral with the cartridge.

26. The improved cartridge according to claim 24 wherein the extending guide portion is arcuate in cross-section.

27. The improved cartridge according to claim 24 further including latching means releasably affixing the cartridge.

28. The improved cartridge according to claim 27 wherein the latching means include slots in the frontwall and a flexible finger formed in the sidewall opposite the frontwall for engaging mating members.

29. The improved cartridge according to claim 24 wherein the upwardly extending guide portion is formed integral with said front sidewall.

30. The improved cartridge according to claim 24, wherein the upwardly extending portion of the front sidewall extends above the upper wall of the cartridge.

* * * * *